US008807787B2

(12) United States Patent
Saito

(10) Patent No.: US 8,807,787 B2
(45) Date of Patent: Aug. 19, 2014

(54) ILLUMINATION DEVICE

(75) Inventor: Takashi Saito, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/522,755

(22) PCT Filed: Feb. 23, 2011

(86) PCT No.: PCT/JP2011/053978

§ 371 (c)(1),
(2), (4) Date: Jul. 18, 2012

(87) PCT Pub. No.: WO2011/105423

PCT Pub. Date: Sep. 1, 2011

(65) Prior Publication Data

US 2012/0287618 A1 Nov. 15, 2012

(30) Foreign Application Priority Data

Feb. 23, 2010 (JP) ..... 2010-037914

(51) Int. Cl.
*F21V 9/00* (2006.01)

(52) U.S. Cl.
USPC ..... 362/230; 362/231; 362/293; 362/294; 362/545; 362/800

(58) Field of Classification Search
USPC ..... 362/230, 231, 293, 294, 545, 800
See application file for complete search history.

(56) References Cited

U.S. PATENT DOCUMENTS

2010/0202140 A1 8/2010 Rooymans et al.
2010/0220471 A1 9/2010 Rooymans

FOREIGN PATENT DOCUMENTS

JP 2007-242258 9/2007
WO 2009/013317 1/2009

*Primary Examiner* — Meghan Dunwiddie
(74) *Attorney, Agent, or Firm* — Greenblum & Bernstein, P.L.C.

(57) ABSTRACT

The illumination device has a lamp fixing on the upper end of the support rod standing on the walkway to be located in a side of the roadway. An inside circumferential surface of the lamp fixing has a first arrangement surface inclined upwardly from the walkway to the roadway and a second arrangement surface inclined upwardly from the roadway to the walkway. The first arrangement surface and the second arrangement surface are provided with the light emitting diodes, respectively. The color of the light of the light emitting diode on the first arrangement surface and the second arrangement surface are set such that the S/P ratio of the scotopic luminance to the photopic luminance of the light emitting diode on the second arrangement surface is greater than that of the first arrangement surface.

12 Claims, 2 Drawing Sheets

ILLUMINATION DEVICE

TECHNICAL FIELD

This invention relates to an illumination device which is mainly used as a street lamp.

BACKGROUND ART

Conventionally, the street lamp is disposed in a side-above portion of the street to illuminate both the roadway and the walkway. In addition, recently, the street lamp having the light emitting diode (hereinafter referred to as LED) which is defined as the light source is proposed. (Refer to as Patent literature 1 explained below) The street lamp with LED as the light source easily produces the light with intended distribution without the reflection board. In addition, the street lamp comprising the light emitting diode has an advantageous in respect of the small size and the lightweight.

CITATION LIST

Patent Literature 1: Japanese patent application publication No. 2007-242258A

SUMMARY OF INVENTION

Problem to Solve

However, the street lamp has an illumination range over "the center portion of the field of view such as the roadway" to "the side portion of the field of view such as the walkway" when seen from the driver on the vehicle. In contrast, the visual cell of the human has a cone cell and a rod cell. The cone cell is concentrated in the fovea centralis of the retina. Therefore, in the center portion of the vision, the cone cell mainly acts. That is, in the peripheral portion of the vision, the cone cell mainly acts. In addition, the cone cell and the rod cell are different in the sensitivity of the eye from each other.

Patent literature 1 has no consideration of the property of the sensitivity of the eye of the human. Therefore, Patent literature 1 has no mention of improving the visibility in view of the difference between the center portion of the vision and the peripheral portion of the vision.

This invention is achieved in view of the above. The objective of this invention is to produce an illumination with consideration of the difference between the center portion of the vision and the peripheral portion of the view to produce the illumination device for improving the visibility in the peripheral portion of the view.

Solution to Problem

In order to solve the objective, this invention discloses the illumination device which is used to illuminate a main illumination space corresponding to a center portion of a field of view and a sub illumination space corresponding to a space corresponding to a peripheral portion of the field of view. The illumination device comprises a main illumination member being configured to illuminate the main illumination space and a sub illumination member being configured to illuminate the sub illumination space. Each the main illumination member and the sub illumination member has S/P ratio which is ratio of a scotopic luminance which is a product obtained by multiplying the spectral distribution property by the scotopic sensitivity to a photopic sensitivity which is a produce obtained by multiplying the spectral distribution property by the photopic sensitivity. The main illumination member and the sub illumination member are set their color of light such that S/P ratio of the sub illumination member is set to be greater than S/P ratio of the main illumination member.

In addition, it is preferred that the main illumination member and the sub illumination member comprises the light emitting diodes which are defined as the light source.

The illumination device may have a light fixing which is disposed above the space to be illuminated. The light fixing has a first arrangement surface having the upper inclination and a second arrangement surface having the upper inclination. The upper inclination of the first arrangement surface extends to the upper direction as the upper inclination of the first arrangement surface extends in a direction from the sub illumination space to the main illumination space. The upper inclination of the second arrangement surface extends to the upper direction as the upper inclination of the second arrangement surface extends in a direction from the main illumination space to the sub illumination space. The main illumination member is formed by the first arrangement surface and the light source on the first arrangement surface. The sub illumination member is formed by the second arrangement surface and the light source on the second arrangement surface.

It is preferred that the main illumination member is set to emit the light having the color of the electrical light bulb color. In addition, it is preferred that the sub illumination member is set to emit the light having the white color.

In addition, the main illumination space is not limited to a space corresponding to the field of view. Similarly, the sub illumination space is not limited to the space corresponding to the field of view. That is, the main illumination space and the sub illumination space are arbitrarily set.

That is, the illumination device is used for illuminating the main illumination space and the sub illumination space. The illumination device has a main illumination member and a sub illumination member. The main illumination member is configured to illuminate the main illumination space. The sub illumination member is configured to illuminate the sub illumination space. The main illumination member has a spectral distribution property and a scotopic sensitivity. The product obtained by multiplying the spectral distribution property of the main illumination member and the scotopic sensitivity of the main illumination member is defined as the scotopic luminance of the main illumination member. The main illumination member has a spectral distribution property and the photopic sensitivity. The product obtained by multiplying the spectral distribution property of the main illumination member and the photopic sensitivity of the main illumination member is defined as the photopic luminance of the main illumination member. The ratio of the scotopic luminance of the main illumination member to the photopic luminance of the main illumination member is defined as S/P ratio of the main illumination member. The sub illumination member has a spectral distribution property and the scotopic sensitivity. The product obtained by multiplying the spectral distribution property of the sub illumination member by the scotopic sensitivity of the sub illumination member is defined by the scotopic luminance of the sub illumination member. The sub illumination member has a spectral distribution property and the photopic sensitivity. The product obtained by multiplying the spectral distribution property of the sub illumination member by the photopic sensitivity of the sub illumination member is defined by the photopic luminance of the sub illumination member. The ratio of the scotopic luminance of the sub illumination member to the photopic luminance of the sub illumination member is defined as S/P ratio. The main illumination member and the sub illumination member are set their colors of lights such that S/P ratio of the sub illumination member is set to be greater than S/P ratio of the main illumination member.

If the scotopic luminance of the main illumination member is defined as Ls1, the scotopic luminance Ls1 of the main illumination member preferably satisfies the following equation.

$$Ls1=\int f1(\text{lambda})\times h(\text{lambda})d\ \text{lambda}$$

f1(lambda) is a spectral distribution of the light emitted from the main illumination member.

h(lambda) is a property of the sensitivity of the scotopic vision.

In addition, if the photopic luminance of the main illumination member is defined as Lp1, the photopic luminance Lp1 of the main illumination member preferably satisfies the following equation.

$$Lp1=\int f1(\text{lambda})\times g(\text{lambda})d\ \text{lambda}$$

f1(lambda) is a spectral distribution of the light emitted from the main illumination member.

g(lambda) is a property of the sensitivity of the photopic vision.

In addition, if the scotopic luminance of the sub illumination member is defined as Ls2, the scotopic luminance Ls2 of the sub illumination member preferably satisfies the following equation.

$$Ls2=\sim f2(\text{lambda})\times h(\text{lambda})d\ \text{lambda}$$

f2(lambda) is a spectral distribution of light emitted from the sub illumination member.

h(lambda) is a property of the sensitivity of the scotopic vision.

In addition, if the photopic luminance of the sub illumination member is defined as Lp2, the photopic luminance Lp2 of the sub illumination member preferably satisfies the following equation.

$$Lp2=\int f2(\text{lambda})\times g(\text{lambda})d\ \text{lambda}$$

f2(lambda) is a spectral distribution of light emitted from the sub illumination member.

g(lambda) is a property of the sensitivity of the photopic vision.

In addition, when S/P ratio of the main illumination member is defined as S1/P1, S1/P1 is defined by the following equation.

$$S1/P1=Ls1/Lp1$$

In addition, when S/P ratio of the sub illumination member is defined as S2/P2, S2/P2 is defined by the following equation.

$$S2/P2=Ls2/Lp2$$

In addition, the main illumination member and the sub illumination member are set their lights having the colors such that S2/P2 is set to be greater than S1/P1.

Advantageous Effects of Invention

According to this configuration, the illumination device comprises the main illumination member configured to illuminate the main illumination space corresponding to the center portion of the vision, the sub illumination member configured to illuminate the sub illumination space corresponding to the peripheral portion of the vision. In addition, the colors of the lights of the main illumination member and the sub illumination member are differentiated from each other with taking into consideration of the difference of the sensitivity of the eyes in the vision. Therefore, it is possible to improve the visibility in the peripheral portion of the vision.

DESCRIPTION OF EMBODIMENTS

The embodiment explained below is made with the street lamp as the illumination device. However, it should be noted that, in a case where the illumination device is used in the operation of the user who watches the peripheral portion in addition to the front direction, it is possible to apply the technical thought to the invention to the illumination device other than the above. For example, when providing the illumination to the ski area, skier has to pay high visibility to the side area in addition to pay high visibility to the front area. Therefore, the technical thought is able to apply this invention.

(Principle)

Figure 2:
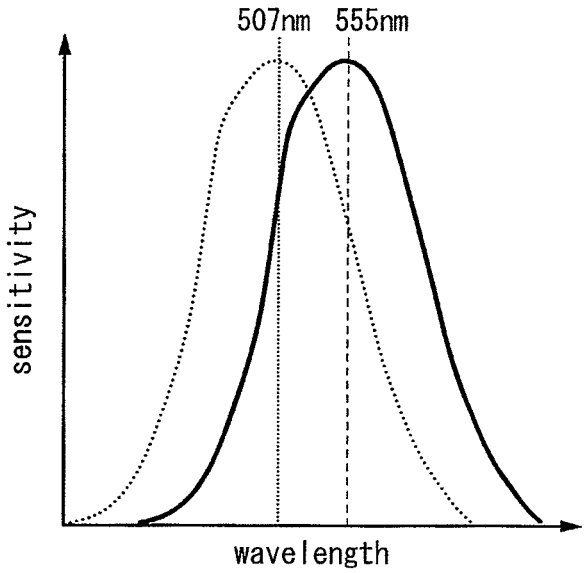
FIG. 2 shows a property of sensitivity of the eyes.

The property of the sensitivity of the eyes of the human in the center portion of the field of view depends on the function of the cone cell, thereby corresponding to the sensitivity of the photopic vision. In contrast, the property of the sensitivity of the eyes of the human in the peripheral portion of the field of view depends on the function of the rod cell, thereby corresponding to the sensitivity of the scotopic vision. Therefore, as shown in the solid curved line of FIG. 2, the sensitivity in the center portion within the field of view reaches its maximum at 555 nanometers. As shown in the broken curved line of FIG. 2, the sensitivity in the peripheral portion within the field of view reaches its maximum at 507 nanometers. According to these properties of the sensitivities, when illuminating with the illumination device, it is contemplated that differentiating "the color of the light in the peripheral portion of the field of view" from "the color of the light in the center portion of the field of view" makes it possible to enhance the visibility.

Taking into consideration of the contemplation, this invention employs the technique of differentiate "the spectral distribution property of the illumination (main illumination member) for the main illumination space which is a space corresponding to the center portion of the field of view" from "the spectral distribution property of the illumination (sub illumination member) for the sub illumination space which is a space corresponding to the peripheral portion of the field of view".

Hereinafter, the spectral distribution of the light emitted from the illumination device is represented as follows.

f(lambda)

The property of the sensitivity of the photopic vision is represented as follows.

g(lambda)

The property of the sensitivity of the scotopic vision is represented as follows.

h(lambda)

Under this definition, calculating the following equations within an entire wavelength in the visible optical region is made.

$\int f(\text{lambda}) \times g(\text{lambda}) d\ \text{lambda}$ $\int f(\text{lambda}) \times h(\text{lambda}) d\ \text{lambda}$ Hereinafter, the former value is referred to as the photopic luminance Lp, and the later value is referred to as the scotopic luminance Ls. In addition, the ratio of the scotopic luminance Ls to the photopic luminance Lp is referred to as S/P ratio. (The ratio of the scotopic luminance Ls to the photopic luminance Lp corresponds to Ls/Lp.)

In the center portion of the field of view, it is contemplated that the higher the photopic luminance Lp becomes, the more improved the visibility is. In contrast, in the peripheral portion of the field of view, it is contemplated that the more the scotopic luminance Ls becomes high, the more the visibility is improved. Therefore, in the space corresponding to the center portion of the field of view, the visibility is improved as the S/P ratio becomes small. In contrast, in the space corresponding to the peripheral portion of the field of view, the visibility is improved as the S/P ratio becomes great.

Embodiment

In this embodiment, explanation of the embodiment with the above principle is made with the example of using the street lamp which is improved its visibility in the roadway and walkway of the driver of the vehicle. In the driver on the vehicle, the space corresponding to the center portion of the field of view is a roadway. The space corresponding to the peripheral portion of the field of view is the walkway.

Figure 1A:
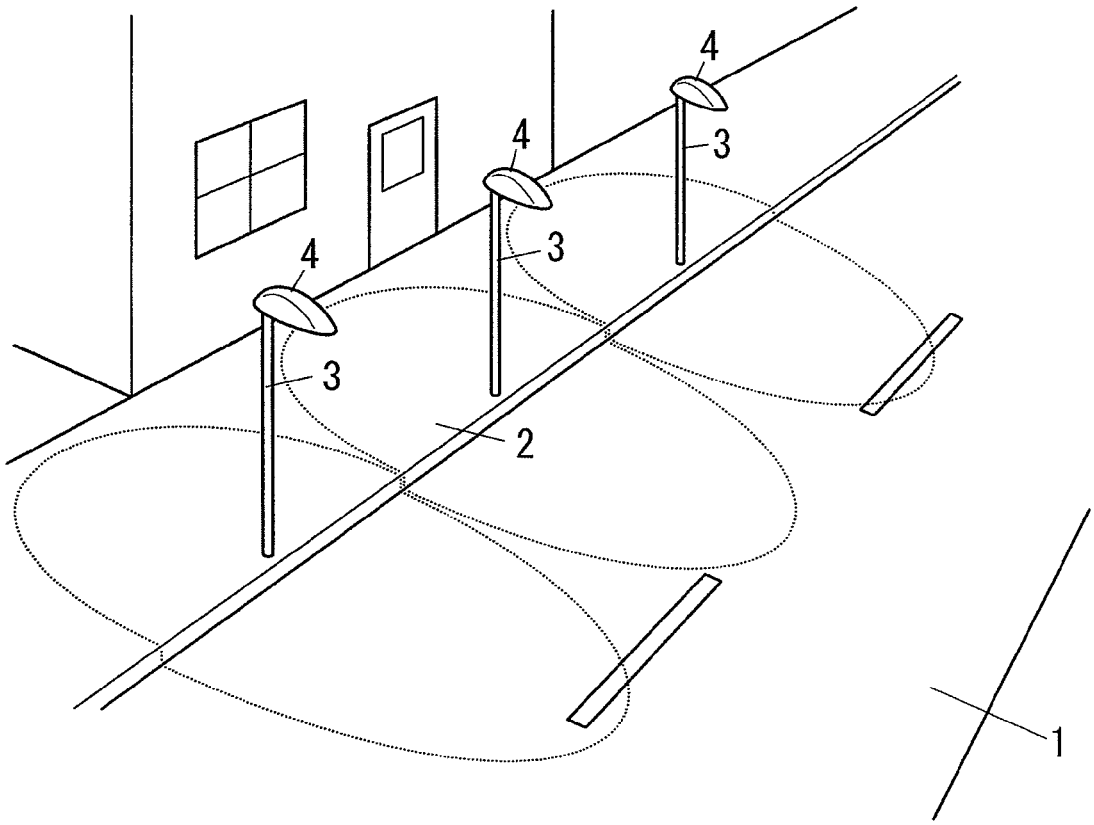
FIG. 1A shows a perspective view showing the usage example of the embodiment.

As shown in FIG. 1A, the street is assumed to comprise the roadway 1 and the walkway 2. In addition, the support rod 3 is installed to the walkway 2 to stand by the roadway 1. The support rod 3 is provided at its upper end with the lamp fixing 4 which is configured to illuminate the roadway 1 and the walkway 2. Therefore, directly beneath the lamp fixing 4 corresponds to the vicinity of boundary of the roadway 1 and the walkway 2.

Figure 1B:
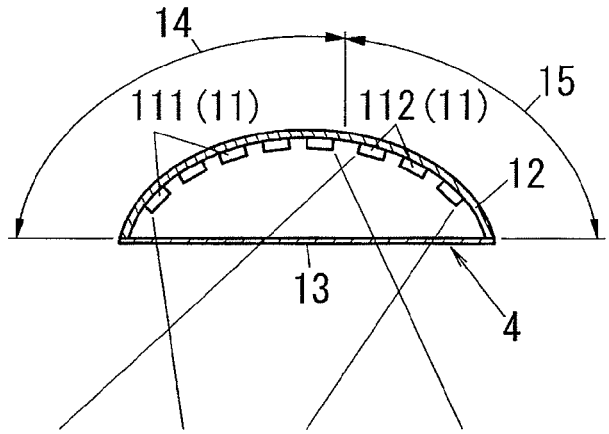
FIG. 1B shows a main cross sectional view of the embodiment.

The lamp fixing 4 is, as shown in FIG. 1B, provided with a light emitting diode 11 (hereinafter referred to as LED) which acts as the light source, an upper cover 12 which is directed downwardly and which incorporates the LED 11 therein, and the lower cover 12 which is configured to cover the opening of the upper cover and which has a translucency. The upper cover 12 is preferably made of the metal. If "the upper cover 12 is made of metal" and "a plurality of LEDs 11 are arranged on an inside surface of the upper cover 12 with close contact with respect to the upper cover 12", the LEDs 11 are allowed to release their heat through the upper cover 12.

The upper cover 12 has an inner circumferential surface which is a recess surface which is set back to the upper direction to have a cross section (the cross section shown in FIG. 1) taken along a direction perpendicular to the extending direction of the road way 1. (The extending direction of the road way 1 is, in other words, the direction along which the vehicle runs.) The inner circumferential surface has a first arrangement surface 14 having an upper inclination extending from a side of the street to a center of the street and a second arrangement surface 15 having a lower inclination extending from the center of the street to the side of the street. (Extending from a side of the street to the center of the street is, in other words, extending from a side of the walkway to a side of the roadway.)

Therefore, when arranging the LED 11 on the first arrangement surface 14, the illumination light is provided to the roadway 1. In addition, when arranging the LED 11 on the second arrangement surface 15, the illumination light is provided to a direction opposite of the roadway 1. In addition, the lamp fixing 4 has the recess which has an inner circumferential surface concaved upwardly. Therefore, if the LED 11 is arranged in the boundary portion between the first arrangement surface 14 and the second arrangement surface 15, it is possible to illuminate directly below the lamp fixing 4.

In contrast, as explained in the above as the principle, the sensitivity in the center portion of the field of view is different from the sensitivity of the peripheral portion of the field of view. Therefore, it is preferred that the illumination light provided to the space corresponding to the center portion of the field of view is differentiated in the spectral distribution from the illumination light provided to the space corresponding to the peripheral portion of the field of view. That is, according to the above explained principle, it is desired for the driver of the vehicle that the illumination light provided to the roadway 1 is different in the spectral distribution from the illumination light provided to the walkway 2.

In this embodiment, according to the knowledge of the above, the lamp fixing 4 is provided with the LEDs 11 having a plurality sorts of the color of the light as the light source. In addition, each the LEDs 11 having the light color are varied their illumination areas from each other. In particular, the LEDs 111 which has the color of light and the luminance which are necessary for ensuring the illumination of the roadway 1 are mainly arranged on the first arrangement surface 14, and the LEDs 112 which has the color of the light and the luminance which are necessary for ensuring the illumination of the walkway 2 are mainly arranged on the second arrangement surface 15. Therefore, the first arrangement surface 14 is cooperative with the LEDs 111 to construct the main illumination member. The second arrangement surface 15 is cooperative with the LEDs 112 to construct the sub illumination member 112. LED 111 (in the main illumination member) and the LED 112 (in the sub illumination member) may have a various combination as long as the principle explained in the above is satisfied.

Desirably, the LEDs 111 for mainly illuminate the roadway 1 is configured to emit the light having the color of the electrical light bulb. The LEDs 112 for illuminating the walkway 2 is configured to emit the light having the white color. According to this combination, it is possible to set the S/P ratio in the walkway 2 to be higher than the S/P ratio in the roadway 1. Therefore, compared with a case where the illumination in the walkway 2 is employed to emit the light having the color of the electrical light bulb similar to that in the roadway 1, it is possible to enhance the visibility about the walkway 2 for the driver. That is, the driver is able to quickly realize the human and the animal moving from the walkway 2 into the roadway 1.

In the above embodiment, the first arrangement surface 14 and the second arrangement surface 15 are formed in approximately symmetrical with each other. In addition, the number of the LEDs 111 on the first arrangement surface 14 is greater than the number of the LEDs 112 on the second arrangement surface 15. In this manner, if it is possible that the number of the LEDs 111 is smaller than the number of the LEDs 112, it is possible to form the first arrangement surface 14 and the second arrangement surface in asymmetrical with each other. In any cases, adjusting at least one of "the shapes of the first arrangement surface 14 and the second arrangement surface 15" and "the number of the LEDs 111 and the LEDs 112" makes it possible to illuminate the necessary area in the roadway 1 and the walkway 2. This results in the prevention of the light pollution.

The combination of the color of the light of the LEDs 111 on the first arrangement surface 14 and the LEDs 111 on the second arrangement surface 15 is not limited thereto, thereby being selected on the basis of the S/P ratio, arbitrarily. For example, it is possible to set employ the LEDs 111 emitting the light with white color to illuminating the roadway 1, and set to employ the LEDs 112 emitting the light with green color to illuminate the walkway 2. To simplify the explanation, it is possible to determine the color of the light such that the color of the light provided to the walkway 2 contains much more short wavelength content than the short wavelength content of the color of the light provided to the roadway 1.

Figure 3A:
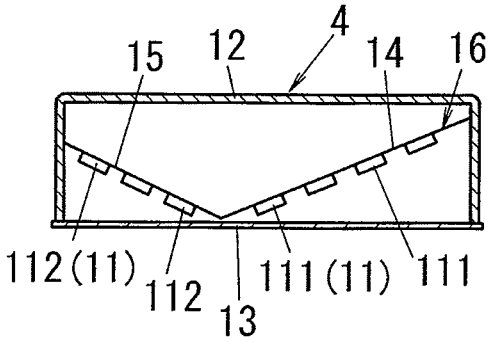
FIG. 3 shows a main cross sectional view indicating another embodiment.
Figure 3B:
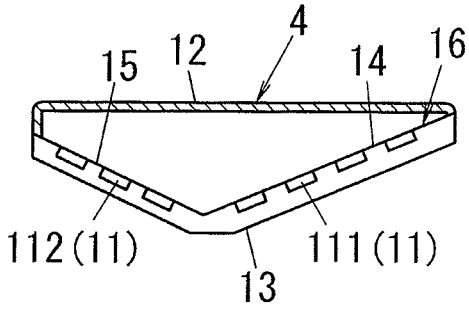

The lamp fixing 4 may, as shown in FIG. 3 A, have a cross section (perpendicular to the extending direction of the roadway 1) of rectangular shape. In the configuration of FIG. 3 A, the upper cover 12 is provided at its inside with the mounting unit 16. The mounting unit 16 is provided at its lower surface with a projection surface projected to the lower direction. Consequently, the mounting unit 16 has a first arrangement surface 14 having an upper inclination which extends to the upper direction as extends from the walkway 2 to the roadway 1 and a second arrangement surface 15 having a lower inclination extends to the lower direction as extends from the walkway 2 to the roadway 1. The first arrangement surface 14 and the second arrangement surface 15 are both flat surfaces. The boundary between the first arrangement surface 14 and the second arrangement surface 15 are defined as the lower end of the mounting unit 16.

In this configuration, the LEDs 111 on the first arrangement surface 14 (in main illumination member) are provided for illuminating the roadway 1. The LEDs 112 on the second arrangement surface 15 (in the sub illumination member) are provided for illuminating the walkway 2. In addition, even if the lower cover 14 with the light scattering and permeable properties is added thereto, it is possible to provide the illumination while separating the color of the light from the main illumination member from the color of the light from the sub illumination member.

When employing the lamp fixing 4 of the above shape, an amount of the light which directly reaches beneath the lamp fixing 4 from the LEDs 111, 112 is relatively decreased. However, the light emitted from the LEDs 111, 112 is diffused, thereby being reached beneath the lamp fixing 4. In addition, the reflected light which is reflected by the inside surface of the upper cover 12 is diffused, thereby being reached beneath the lamp fixing 4. Therefore, it is possible to keep the illumination intensity which is in the same extent to the illumination intensity of the configuration shown in FIG. 1B. In addition, the configuration in FIG. 3 A makes it possible to emit the light from the LEDs 111, 112 to a wide range.

As shown in FIG. 3 B, instead of the lower cover 13 having the flat shape shown in FIG. 3 A, it is possible to employ the lower cover 13 which has a shape along the lower surface of the mounting unit 16. In the shape shown in FIG. 3 B, it is possible to make the lamp fixing 4 thinner. In addition, in the shape shown in FIG. 3 B, an amount of the light provided directly beneath the lamp fixing 4 is relatively decreased. Therefore, if the roadway 1 and the walkway 2 are separated from each other by the shrubbery, it is effective to prevent the illumination to the unnecessary region. In the configuration shown in FIG. 3 B, there is no reflection by the side wall of the upper cover 12. Therefore, it is possible to emit the light to further wide range, compared with the configuration shown in FIG. 3 A.

The above shows the example of the lamp fixing 4 provided to the upper end of the support rod 3, it is possible to provide the proper structure disposed above the road with the lamp fixing 4. In addition, it is possible to provide the structure such as the building in the roadway side and the soundproof wall with the lamp fixing 4. However, in the lamp fixing 4 provided to the structure such as the building in the roadway side and the soundproof wall, it is necessary to modify the designing of the first arrangement surface 14 and the second arrangement surface 15.

As explained above, the illumination device of this invention is provided for illuminating the main illumination space and the sub illumination space. The illumination device comprises a main illumination member for illuminating the main illumination space and a sub illumination member for illuminating the sub illumination space. The main illumination member has a spectral distribution property, a scotopic sensitivity, and a photopic sensitivity. The product obtained by multiplying the spectral distribution property of the main illumination member by the scotopic sensitivity of the main illumination member is defined as the scotopic luminance of the main illumination member. The product obtained by multiplying the spectral distribution property of the main illumination member by the photopic sensitivity of the main illumination member is defined as the photopic luminance of the main illumination member. The ratio of the scotopic luminance of the main illumination member to the photopic luminance of the main illumination member is defined as S/P ratio of the main illumination member. The sub illumination member has a spectral distribution property, the scotopic sensitivity, and the photopic sensitivity. The product obtained by multiplying the spectral distribution property of the sub illumination member by the scotopic sensitivity of the sub illumination member is defined as the scotopic luminance of the sub illumination member. The product obtained by multiplying the spectral distribution property of the sub illumination member by the photopic sensitivity of the sub illumination member is defined as the photopic luminance of the main illumination member. The ratio of the scotopic luminance of the sub illumination member to the photopic luminance of the sub illumination member is defined as S/P ratio of the sub illumination member. The colors of the lights emitted from the main illumination member and the sub illumination member are set such that S/P ratio in the sub illumination member is set to be greater than the S/P ratio in the main illumination member.

In addition, when the scotopic luminance of the main illumination member is defined as Ls1, it is preferred that the scotopic luminance Ls1 of the main illumination member satisfies the following equation.

$$Ls1=\int f1(\text{lambda})\times h(\text{lambda})d\ \text{lambda}$$

f1(lambda) is a spectral distribution of the light emitted from the main illumination member.

h(lambda) is sensitivity in the scotopic vision.

In addition, when the photopic luminance of the main illumination member is defined as Lp1, it is preferred that the photopic luminance Lp of the main illumination member satisfies the following equation.

$$Lp1=\int f1(\text{lambda})\times g(\text{lambda})d\ \text{lambda}$$

f1(lambda) is a spectral distribution of the light emitted from the main illumination member.

g(lambda) is sensitivity of the photopic vision.

In addition, when the scotopic luminance of the sub illumination member is defined as Ls2, it is preferred that the scotopic luminance Ls2 of the sub illumination member satisfies the following equation.

$$Ls2=\int f2(\text{lambda})\times h(\text{lambda})d\ \text{lambda}$$

f2(lambda) is a spectral distribution of the light emitted from the sub illumination member.

h(lambda) is sensitivity of the scotopic vision.

In addition, when the photopic luminance of the sub illumination member is defined as Lp2, it is preferred that the photopic luminance Lp2 of the sub illumination member satisfies the following equation.

$$Lp2=\int f2(\text{lambda})\times g(\text{lambda})d\,\text{lambda}$$

f2(lambda) is a spectral distribution of the light emitted from the sub illumination member.

g(lambda) is sensitivity of the photopic vision.

In addition, when the S/P ratio of the main illumination member is defined as S1/P1, S1/P1 is defined by the following equation.

$$S1/P1=Ls1/Lp1$$

In addition, when the S/P ratio of the sub illumination member is defined as S2/P2, S2/P2 is defined by the following equation.

$$S2/P2=Ls2/Lp2$$

In addition, the colors of the lights of the main illumination member and the sub illumination member is set such that S2/P2 which is S/P ratio of the sub illumination member is set to be greater than S1/P1 which is S/P ratio of the main illumination member.

In this case, it is possible to enhance the visibility in the peripheral portion of the main illumination space.

In addition, it is preferred that the main illumination space is a space corresponding to a center portion of the field of view. The sub illumination space is a space corresponding to a peripheral portion of the field of view.

Consequently, it is possible to enhance the visibility in the peripheral portion of the field of view.

In addition, the color of the light of the main illumination member is set to the color of the light of the electrical light bulb. In addition, the color of the light of the sub illumination member is set to the white color.

In addition, the color temperature of the light emitted from the main illumination member is set to a range from 2600 Kelvin or more to 3150 Kelvin or less. The color temperature of the light emitted from the sub illumination member is set to a range from 3900 Kelvin or more to 4500 Kelvin or less. That is, the color of the light of the electrical light bulb corresponds to the range from 2600 Kelvin or more to 3150 Kelvin or less. The white color corresponds to the range from 3900 Kelvin or more to 4500 Kelvin or less.

In this case, it is possible to enhance the visibility of the object in the sub illumination space under a condition where the human watches the space illuminated by the main illumination member.

In addition, it is preferred that the illumination device comprises the lamp fitting. The lamp fitting has a first arrangement surface and a second arrangement surface. The first arrangement surface has an upper inclination in a direction from the sub illumination space to the main illumination space. In other words, the lamp fitting has a first direction which is directed from the sub illumination space to the main illumination space. The first arrangement surface has an upper inclination in the first direction. In other words, the first arrangement surface extends to the upper direction as the first arrangement surface extends to the first direction. The second arrangement surface has an upper inclination in a direction from the main illumination space to the sub illumination space. In other words, the lamp fitting has a second direction extending in a direction from the main illumination space to the sub illumination space. The second arrangement surface has an upper inclination in the second direction. In other words, the second arrangement surface extends to the upper direction as the second arrangement surface extends to the second direction. The main illumination member is formed by arranging the light source on the first arrangement surface. In other words, the main illumination member comprises the first arrangement surface and the light source arranged on the first arrangement surface. The sub illumination member is formed by arranging the light source on the second arrangement surface. In other words, the sub illumination member comprises a second arrangement surface and the light source arranged on the second arrangement surface.

In addition, the first arrangement surface and the second arrangement surface are arranged in a direction from the sub illumination space to the main illumination space.

In addition, the first arrangement surface and the second arrangement surface are directed to the lower direction.

In addition, in one embodiment, the first arrangement surface is located in a side of the first direction than the second arrangement surface. In other words, the first arrangement surface is closer to the main illumination space than the second arrangement surface.

In addition, in one embodiment, the first arrangement surface is located in a side of the second direction rather than the second arrangement surface. In other words, the second arrangement surface is closer to the main illumination space than the first arrangement space.

In this case, the first arrangement surface is directed to the main illumination space. Therefore, the main illumination member illuminates the main illumination space. The second arrangement surface is directed to the sub illumination space. Therefore, the sub illumination member illuminates the sub illumination space. Therefore, it is possible to enhance the visibility.

REFERENCE SIGNS LIST

1 roadway (main illumination space)
2 walkway (sub illumination space)
4 lamp fixing
11 light emitting diode
111 light emitting diode (main illumination member)
112 light emitting diode (sub illumination member)
14 first arrangement surface (main illumination member)
15 second arrangement surface (sub illumination member)

The invention claimed is:

1. An illumination device for illuminating a main illumination space and a sub illumination space, said illumination device comprising:

a main illumination member configured to illuminate the main illumination space, a sub illumination member configured to illuminate the sub illumination space, a scotopic luminance of the main illumination member being defined by a product obtained by multiplying a spectral distribution property of said main illumination member by a scotopic sensitivity of said main illumination member, a photopic luminance of the main illumination member being defined by a product obtained by multiplying the spectral distribution property of said main illumination member by a photopic sensitivity of said main illumination member, a scotopic luminance of the sub illumination member being defined by a product obtained by multiplying a spectral distribution property of said sub illumination member by a scotopic sensitivity of said sub illumination member, a photopic luminance of the sub illumination member being defined by a product obtained by multiplying the spectral distribution property of said sub illumination member by a photopic sensitivity of said sub illumination member, a ratio of the scotopic luminance of the main illumination member to the photopic luminance of the main illumination member being defined as an S/P ratio of the main illumination member, a ratio of the scotopic luminance of the sub illumination member to the photopic luminance of the sub illumination member being defined as an S/P ratio of the sub illumination member, wherein said main illumination space corresponds to a space of a center portion of a field of view, said sub illumination space corresponding to a space of a peripheral portion of the field of the view, and a color of light of said main illumination member and a color of light of said sub illumination member are set such that the S/P ratio of the sub illumination member is set to be greater than the S/P ratio of the main illumination member.

2. The illumination device as set forth in claim 1, wherein said main illumination member and said sub illumination member have light emitting diodes as light sources, respectively.

3. The illumination device as set forth in claim 1, wherein said illumination device comprises a lamp fitting which is disposed above space to be illuminated, said lamp fitting having a first arrangement surface and a second arrangement surface, said first arrangement surface having an upper inclination which extends towards an upper direction as said first arrangement surface extends in a first direction from the sub illumination space to the main illumination space, said second arrangement surface having an upper inclination which extends towards an upper direction as said second arrangement surface extends in a second direction from the main illumination space to the sub illumination space, said main illumination member being provided by the first arrangement surface and the light source on the first arrangement surface, said sub illumination member being provided by the second arrangement surface and the light source on the second arrangement surface.

4. The illumination device as set forth in claim 1, wherein said main illumination member is configured to emit light having a color which corresponds to a color of light emitted from an electrical light bulb, said sub illumination member being configured to emit light having a white color.

5. The illumination device as set forth in claim 1, wherein said main illumination member is configured to emit light having a color temperature of a range from 2600 Kelvin or more to 3150 Kelvin or less, said sub illumination member being configured to emit light having a color temperature of a range from 3900 Kelvin or more to 4500 Kelvin or less.

6. The illumination device as set forth in claim 1, wherein said main illumination space is a roadway, and said sub illumination space is a walkway that extends along the roadway.

7. The illumination device as set forth in claim 3, wherein said first arrangement surface and the second arrangement surface are arranged in a direction from the sub illumination space to the main illumination space.

8. The illumination device as set forth in claim 3, wherein, said first arrangement surface and the second arrangement surface are directed downwardly.

9. The illumination device as set forth in claim 3, wherein said first arrangement surface is positioned more in the first direction than the second arrangement surface.

10. The illumination device as set forth in claim 3, wherein said first arrangement surface is positioned more in the second direction side than the second arrangement surface.

11. An illumination device for illuminating a main illumination space and a sub illumination space, said illumination device comprising:

a main illumination member configured to illuminate the main illumination space, a sub illumination member configured to illuminate the sub illumination space, a scotopic luminance of the main illumination member being defined by a product obtained by multiplying a spectral distribution property of said main illumination member by a scotopic sensitivity of said main illumination member, a photopic luminance of the main illumination member being defined by a product obtained by multiplying the spectral distribution property of said main illumination member by a photopic sensitivity of said main illumination member, a scotopic luminance of the sub illumination member being defined by a product obtained by multiplying a spectral distribution property of said sub illumination member by a scotopic sensitivity of said sub illumination member, a photopic luminance of the sub illumination member being defined by a product obtained by multiplying the spectral distribution property of said sub illumination member by a photopic sensitivity of said sub illumination member, a ratio of the scotopic luminance of the main illumination member to the photopic luminance of the main illumination member being defined as an S/P ratio of the main illumination member, a ratio of the scotopic luminance of the sub illumination member to the photopic luminance of the sub illumination member being defined as an S/P ratio of the sub illumination member, wherein a color of light of said main illumination member and a color of light of said sub illumination member are set such that the S/P ratio of the sub illumination member is set to be greater than the S/P ratio of the main illumination member, and wherein said illumination device comprises a lamp fitting which is disposed above space to be illuminated, said lamp fitting having a first arrangement surface and a second arrangement surface, said first arrangement surface having an upper inclination which extends towards an upper direction as said first arrangement surface extends in a first direction from the sub illumination space to the main illumination space, said second arrangement surface having an upper inclination which extends towards an upper direction as said second arrangement surface extends in a second direction from the main illumination space to the sub illumination space, said main illumination member being provided by the first arrangement surface and the light source on the first arrangement surface, and said sub illumination member being provided by the second arrangement surface and the light source on the second arrangement surface.

12. An illumination device for illuminating a main illumination space and a sub illumination space, said illumination device comprising:

a main illumination member configured to illuminate the main illumination space, a sub illumination member configured to illuminate the sub illumination space, a scotopic luminance of the main illumination member being defined by a product obtained by multiplying a spectral distribution property of said main illumination member by a scotopic sensitivity of said main illumination member, a photopic luminance of the main illumination member being defined by a product obtained by multiplying the spectral distribution property of said main illumination member by a photopic sensitivity of said main illumination member, a scotopic luminance of the sub illumination member being defined by a product obtained by multiplying a spectral distribution property of said sub illumination member by a scotopic sensitivity of said sub illumination member, a photopic luminance of the sub illumination member being defined by a product obtained by multiplying the spectral distribution property of said sub illumination member by a photopic sensitivity of said sub illumination member, a ratio of the scotopic luminance of the main illumination member to the photopic luminance of the main illumination member being defined as an S/P ratio of the main illumination member, a ratio of the scotopic luminance of the sub illumination member to the photopic luminance of the sub illumination member being defined as an S/P ratio of the sub illumination member, wherein a color of light of said main illumination member and a color of light of said sub illumination member are set such that the S/P ratio of the sub illumination member is set to be greater than the S/P ratio of the main illumination member, and wherein said main illumination member is configured to emit light having a color which corresponds to a color of light emitted from an electrical light bulb, said sub illumination member being configured to emit light having a white color.

* * * * *